US005643707A

United States Patent [19]

Larson et al.

[11] Patent Number: 5,643,707

[45] Date of Patent: Jul. 1, 1997

[54] LIQUID DEVELOPER COMPOSITIONS

[75] Inventors: James R. Larson; George A. Gibson, both of Fairport; John W. Spiewak, Webster, all of N.Y.

[73] Assignee: Xerox Corporation, Stamford, Conn.

[21] Appl. No.: 509,408

[22] Filed: Jul. 31, 1995

[51] Int. Cl.[6] ..... G03G 9/12

[52] U.S. Cl. ..... 430/137; 430/116

[58] Field of Search ..... 430/116, 114, 430/137

[56] References Cited

U.S. PATENT DOCUMENTS

| | | | |
|---|---|---|---|
| H1483 | 9/1995 | Larson et al. | 430/115 |
| 3,053,688 | 9/1962 | Greig | 430/116 |
| 3,058,914 | 10/1962 | Metcalfe et al. | 430/116 |
| 3,628,981 | 12/1971 | Matsumoto | 430/118 |
| 5,176,980 | 1/1993 | Santilli et al. | 430/137 |
| 5,290,653 | 3/1994 | Pearlstine | 430/137 |
| 5,306,591 | 4/1994 | Larson et al. | 430/115 |
| 5,308,731 | 5/1994 | Larson et al. | 430/115 |
| 5,328,959 | 7/1994 | Sullivan | 525/196 |
| 5,457,002 | 10/1995 | Beach et al. | 430/116 |

FOREIGN PATENT DOCUMENTS

| | | | |
|---|---|---|---|
| 61-292645 | 12/1986 | Japan | 430/114 |

*Primary Examiner*—Christopher D. Rodee
*Attorney, Agent, or Firm*—E. O. Palazzo

[57] ABSTRACT

A liquid developer comprised of a nonpolar liquid with essentially no volatiles, thermoplastic resin particles, a charge adjuvant, or charge control agent, pigment, and a charge director, and wherein said volatiles are removed by heating.

6 Claims, No Drawings

LIQUID DEVELOPER COMPOSITIONS

BACKGROUND OF THE INVENTION

This invention is generally directed to liquid developer compositions and, more specifically, to liquid developers with mixtures of nonpolar fluids, especially hydrocarbon mixtures, like ISOPAR® and mineral oil, wherein the volatiles, especially low molecular weight volatiles, are removed. More specifically, the present invention is directed to liquid developers containing hydrocarbons wherein undesirable volatiles, such as those of especially high vapor pressure, have been removed by, for example, heating, distillation and the like, resulting in a hydrocarbon mixture with retention times in a gas chromatographic test of, for example, not less than about 13 minutes. In embodiments, the nonpolar fluids are also separated or fractionated to remove the high molecular weight components of the mixture. The liquid inks of the present invention possess excellent viscosity, for example ISOPAR M™ provides a viscosity substantially unchanged from the ISOPAR M™ product as supplied by Exxon Corporation, and superior vapor pressures of 80 ppm at 20° C. In embodiments, the liquid inks of the present invention contain a carrier liquid, colorant, resin, charge control agent, a charge director, and optionally a charge adjuvant. Charge directors such as those comprised of diblock or triblock copolymers of the formula A-B, BAB or A-B-A wherein the polar A block is an ammonium containing segment and B is a nonpolar block segment which, for example, provides for charge director solubility in the liquid ink fluid like ISOPAR™, and wherein the A blocks have a number average molecular weight range of from about 200 to about 120,000; the B blocks have a number average molecular weight range of from about 2,000 to 190,000; the ratio of $M_w$ to $M_n$ is 1 to 5 for the copolymers; and the total number average molecular weight of the copolymer is, for example, from about 4,000 to about 300,000, and preferably about 100,000. The developers of the present invention can be selected for a number of known imaging and printing systems, including high speed, for example over 70 copies per minute, printing, such as xerographic processes, wherein latent images are rendered visible with the liquid developers illustrated herein.

The image quality, solid area coverage and resolution for developed images usually require sufficient toner particle electrophoretic mobility. The mobility for effective image development is primarily dependent on the imaging system selected. The electrophoretic mobility is primarily directly proportional to the charge on the toner particles and inversely proportional to the viscosity of the liquid developer fluid. A 10 to 30 percent change in fluid viscosity caused, for instance, by a 5° C. to 15° C. decrease in temperature could result in a decrease in image quality, poor image development and background development, for example, because of a 5 percent to 23 percent decrease in electrophoretic mobility. Insufficient particle charge can also result in poor transfer of the toner to paper or other final substrates. Poor or unacceptable transfer can result in, for example, poor image developer solid area coverage when insufficient toner is transferred to the final substrate and can also cause image defects such as smears and hollowed fine features.

High vapor concentration of the nonpolar carrier is also disadvantageous. Indoor air quality concerns dictate that printing devices employing nonpolar liquid carrier liquids should not emit significant amounts of the vapor of the carrier fluid into the surrounding environment. High volatility carrier fluids such as ISOPAR H® require expensive removal of the volatile carrier liquid vapors from the air stream of the machine. A noble metal catalyst may be used to oxidize the hydrocarbon carrier to $CO_2$ and water. Such a remediation device adds substantially to the cost of the printing device. Alternatively, the vapors can be recovered. Chilling of the air stream from the printing device condenses both the carrier liquid and water from the paper that the images are being fused to and from the ambient air. Both of these actions which are inextricably linked without separation of the water vapor from the air stream by means of, for instance, a chemical moisture filter, are very costly. The energy required for these condensation processes acids to the total cost of printing, and there is an added cost for disposing of the commingled water-carrier liquid waste stream that is produced. Alternatively the vapors of the carrier liquid can be absorbed on a bed of activated charcoal or other suitable media form which the carrier liquid can either be recovered by appropriate desorbtion procedure or disposed of when the bed becomes saturated. Either of these options add to the cost of the printing process and so are not desirable.

A desirable carrier liquid mixture will be substantially free of volatile components rendering these air quality remediation steps unnecessary.

Examples of acceptable conductivity and mobility ranges for the liquid developers of the present invention are as illustrated herein. These are in embodiments dependent upon the speed at which the printing of developed images is accomplished, and upon the mechanical and electrostatic variables (development potential and developer subsystem design which are to be used.

Conductivities, measured at ambient temperature (21° C. to 23° C.), for developers containing one percent toner solids are considered to be in the high range at 14 to 100 pmhos/centimeters. Medium conductivities are from about 6 to about 13 pmhos/centimeters, and low conductivities are from 0.1 to about 6 pmhos/centimeters. As conductivities increase into the undesirable high range, excess ions can compete with toner particles of the same charge for development of the latent image causing low developed mass resulting in low print density images. Also, with a low to medium conductivity of less than 14 pmhos/centimeter, the liquid toner or developer of this invention can possess a mobility of between about −1 to $1.99\times10^{-10}$ $m^2/Vs$, and preferably −2.00 to $2.49\times10^{-10}$ $m^2/Vs$, and more preferably −2.50 to $5\times10^{-10}$ $m^2/Vs$.

The viscosity of the developer is also important. For example, the speed at which high quality copies, or prints can be obtained in a given device with given electrostatics is determined to a great extent by the viscosity of the carrier liquid. In a specific printing device, with specified electrostatic conditions and an ink with a given zeta potential, the maximum speed at which high quality print can be obtained is influenced by the carrier liquid viscosity. As the viscosity of that career liquid increases, the maximum speed at which high quality printing can be accomplished decreases. For a given nonpolar carrier liquid mixture, it is important to minimize the viscosity to, for example, enable an excellent printing speed range.

The above and other advantages are achievable with the liquid inks of the present invention.

A latent electrostatic image can be developed with toner particles dispersed in an insulating nonpolar liquid. The aforementioned dispersed materials are known as liquid toners or liquid developers. A latent electrostatic image may be generated by providing a photoconductive layer with a uniform electrostatic charge, and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, it is developed by colored toner particles dispersed in a nonpolar liquid. The image may then be transferred to an intermediate member for transfer to a receiver sheet, or it can be directly transferred to a receiver sheet.

Liquid developers can comprise a thermoplastic resin and a dispersant nonpolar liquid. Generally, a suitable colorant, such as a dye or pigment, is also present in the developer. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 10 microns (pro) average by area size as measured using the Horiba Capa 500 or 700 particle sizer.

Since the formation of images depends, for example, on the difference of charge between the toner particles in the liquid developer and the latent electrostatic image to be developed, it has been found desirable to add a charge control agent, charge director compound and charge adjuvants which increase the magnitude of the charge on the developer particle. Charge adjuvants such as polyhydroxy compounds, amino alcohols, polybutylene succinimide compounds, aromatic hydrocarbons, metallic soaps, and the like may be added to the liquid developer comprising the thermoplastic resin, the charge control agent, the charge director, the nonpolar liquid and the colorant. Other additives, such as those that modify slip or gloss, may optionally be added. Specifically, titania, silicas and waxes are common additives, but many are known in the art.

U.S. Pat. No. 5,019,477, the disclosure of which is totally incorporated herein by reference, illustrates a liquid electrostatic developer comprising a nonpolar liquid, thermoplastic resin particles, and a charge director. The ionic or zwitterionic charge directors disclosed may include both negative charge directors such as lecithin, oil-soluble petroleum sulfonate and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene, and (iv) selected from the group consisting of butadiene and acrylate.

U.S. Pat. No. 5,030,535 discloses a liquid developer composition comprising a liquid vehicle, a charge control additive and toner particles. The toner particles of resin and optional charge adjuvant may contain pigment particles, wherein the resin can be selected from the group consisting of polyolefins, halogenated polyolefins and mixtures thereof, and in embodiments thermoplastics generally. The liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles.

U.S. Pat. No. 5,026,621 discloses a toner for electrophotography which comprises as main components a coloring component and a binder resin which is a block copolymer comprising a functional segment (A) of at least one of a fluoroalkylacryl ester block unit or a fluoroalkyl methacryl ester block unit, and a compatible segment (B) of a fluorine-free vinyl or olefin monomer block unit. The functional segment of the block copolymer is oriented to the surface, and the compatible segment thereof is oriented to be compatible with other resins and a coloring agent contained in the toner so that the toner is provided with both liquid repelling and solvent soluble properties.

Moreover, in U.S. Pat. No. 4,707,429, the disclosure of which is totally incorporated herein by reference, there are illustrated, for example, liquid developers with an aluminum stearate charge additive. Liquid developers with charge directors are illustrated in U.S. Pat. No. 5,045,425.

Also of relevance with respect to the present invention is U.S. Pat. No. 5,176,980.

In copending patent application U.S. Ser. No. 986,316, the disclosure of which is totally incorporated herein by reference, there is illustrated a process for forming images which comprises (a) generating an electrostatic latent image; (b) contacting the latent image with a developer comprising a colorant and a substantial amount of a vehicle, which developer has a melting point of at least about 25° C., the contact occurring while the developer is maintained at a temperature at or above its melting point, the developer having a viscosity of no more than about 500 centipoise and a resistivity of no less than about 108 ohm-cm at the temperature maintained while the developer is in contact with the latent image; and (c) cooling the developed image to a temperature below its melting point subsequent to development.

In U.S. Statutory Invention Registration No. H1483, U.S. Pat. No. 5,306,591, and U.S. Pat. No. 5,308,731, the disclosures of which are totally incorporated herein by reference, there is illustrated the following: a liquid developer comprised of a certain nonpolar liquid, thermoplastic resin particles, a nonpolar liquid soluble ionic or zwitterionic charge director, and a charge adjuvant comprised of an aluminum hydroxycarboxylic acid, or mixtures thereof; U.S. Pat. No. 5,306,591 discloses a liquid developer comprised of thermoplastic resin particles, a charge director, and a charge adjuvant comprised of an imine bisquinone; and U.S. Pat. No. 5,308,731 discloses a liquid developer comprised of a liquid, thermoplastic resin particles, a nonpolar liquid soluble charge director, and a charge adjuvant comprised of a metal hydroxycarboxylic acid.

Illustrated in U.S. Pat. No. 5,409,796 is a positively charged liquid developer comprised of thermoplastic resin particles, optional pigment, a charge director, and a charge adjuvant comprised of a polymer of an alkene and unsaturated acid derivative; and wherein the acid derivative contains pendant ammonium groups, and wherein the charge adjuvant is associated with or combined with the resin and the optional pigment; and U.S. Pat. No. 5,411,834 is a negatively charged liquid developer comprised of thermoplastic resin particles, optional pigment, a charge director, and an insoluble charge adjuvant comprised of a copolymer of an alkene and an unsaturated acid derivative, and wherein the acid derivative contains pendant fluoroalkyl or pendant fluoroaryl groups, and wherein the charge adjuvant is associated with or combined with said resin and said optional pigment.

Carrier liquids containing commercial mixtures of ISOPARS® and NORPARS® (products of Exxon Chemical and of the Sol B series (products of Shell Chemicals) have an initial boiling point of at least 150° C. and boiling point ranges less than 12° C. Such fluids can possess high vapor pressures unless they are scrupulously free of low molecular weight impurities. Isomers of pure hydrocarbons may be suitable, however, such materials are costly. Boiling point and boiling point range does not usually provide a process for the to selection or production of low cost, low viscosity, low vapor concentration carrier liquids, since for example boiling is a macroscopic phenomena concerned with the behavior of the bulk of the material, and vapor concentration can easily be influenced to a large extent by the presence of small amounts of a volatile impurity.

One procedure used to determine the concentration of hydrocarbon mixtures in the gas phase in equilibrium above the liquid is illustrated hereinafter. Normal linear hydrocarbon standards were obtained from Polyscience Corporation, Evanston, Ill.; and HPLC-GC/MS grade methylene chloride was obtained from Fisher Scientific, Rochester, N.Y. A Varian Model 3700 gas chromatograph equipped with a split/splitless capillary column injector and a flame ionization detector was used for the headspace and direct injections. GC separations were prepared using a 60 meter 0.32 millimeter I.D., 1 micron film thickness DB-5 column supplied by J & W Scientific. The GC oven temperature was programmed from 1,000° C. (0 minutes hold time) to 2,450° C. (hold 15 minutes) at a rate of 100° C./minute. The headspace sample injection volume was 2 milliliters. The liquid standard injection volume was 1 μl. A Chromperfect integrator was used for data collection, storage and integration. The samples were heated using a Vanlab block heater supplied by VWR Scientific in Rochester, N.Y. 22 Milliliters screw cap vials with hole caps and septa from Supelco, Inc. (Bellefonte, Pa.) were used to contain and equilibrate the hydrocarbon samples in an aluminum block that was specially made to fit the Vanlab block heater. A 2 milliliter Pressure-Lok (Series A) syringe made by Precision Sampling in Baton Rouge, La. was used for transfer of the headspace gas to the gas chromatograph.

One milliliter of mixed hydrocarbon sample was sealed in the headspace vial and allowed to equilibrate for 30 minutes at the desired temperature prior to analysis. Two (2) milliliters of headspace gas were injected into the gas chromatograph. Peak areas of the detected hydrocarbons were used for quantitation against an external standard curve made using the standards described below.

Ten microliters of each normal linear hydrocarbon were diluted in 10 milliliters of methylene chloride. 1 Microliter of standard was injected into the gas chromatograph. The chromatogram obtained is used to determine the average carbon number for the mixed hydrocarbon gas phase sample and as an external calibration for these gas phase hydrocarbons. The micrograms of hydrocarbon injected into the gas chromatograph are converted to a gas phase concentration of the hydrocarbon using the formula below. The formula was derived from the ideal gas law (PV=nRT) and uses 1 atmosphere (760 millimeters) for pressure, 2,930 degrees Kelvin for temperature and assumes the liquid volume was expanded into 2 milliliters of air (the volume used for the headspace analysis).

$$ppm(v/v)=(\text{density/molecular weight})\times 12{,}019.23$$

The chromatogram from the headspace gas of the mixed hydrocarbon is compared to the chromatogram from the injection of the liquid standard of normal hydrocarbons. The peak area for the standard normal hydrocarbon nearest the center of the distribution of hydrocarbons in the gas phase is compared to the total peak area of all the hydrocarbons in the gas phase for the purpose of quantitation. This is possible because the distribution of hydrocarbons in the gas phase is usually Gausian and any differences in response of the flame ionization detector due to differing numbers of carbons will average out.

Typical Standard Curve
(For a Distribution Centered at Pentadecane)

| Amount in 10 ml | ppm | Peak Area |
|---|---|---|
| 0 | 0 | 0 |
| 10 μl | 43.48 | 148380 |
| 50 μl | 217.40 | 633530 |

If the sum of all the areas for all the peaks in the chromatogram are used, a standard of the normal hydrocarbon where the peaks are centered can be used because the response factor for the F.I.D. should average out over the high and low ends of the distribution (if the distribution is symmetrical).

Using the above process technique the differences in the composition of the liquid phase and the vapor in equilibrium with it can be demonstrated. This point is usefully illustrated by the case of Superla 5NF, a light mineral mineral oil.

This mineral oil material is comprised of an extremely large number of aliphatic hydrocarbons of varied structure including normal chained, branched chain and cyclic materials. The distribution is centered about n-heptadecane and less than 1 percent of the material has a retention time less than that of n-tridecane. The boiling point of this material is greater than 273° C. In spite of this high boiling point, the vapor concentration above this fluid is 50 ppm at 25° C. Examination of the distribution of hydrocarbons found in that vapor are such a small fraction of the composition of the liquid that they are essentially undetectable in that liquid.

Selection of a carrier liquid for use in an electrographic, electrophotographic or other similar printing process, requires detailed knowledge of the device in which the process is to be performed. The variables in the device that must be considered include the type of metering of the carrier liquid and the developed image that will be performed, the speed of the printing process, the temperature at which the printing process is carried out, the temperature of the environment in which the printing device is located, and the mechanical and electrostatic details of that printing process. Generally it can be said, however, that performance closer to optimum will be produced as the viscosity of the fluid is reduced and as the vapor concentration above the fluid at the relevant temperature is decreased, and as the requirement for isomeric purity is relaxed yielding lower cost.

The disclosures of each of the copending applications mentioned herein are totally incorporated herein by reference.

SUMMARY OF THE INVENTION

It is an object of the present invention to provide liquid developers with many of the advantages illustrated herein.

Another object of the present invention is to provide liquid developers capable of high particle charging and rapid toner charging rates.

Another object of the present invention is to provide liquid developers with an excellent viscosity.

Another object of the present invention is to provide liquid developers with excellent viscosity of from 1.5 to 20 centipoise at 20° C.

Also, in another object of the present invention there is provided liquid developers with nonpolar liquids with a superior equilibrium vapor concentration of, for example, less than 150 ppm at 20° C.

Further, another object of the present invention is to provide liquid developers with mixed isomeric hydrocarbons wherein undesirable volatiles, that can be a health hazard, are removed by, for example, heating; and in embodiments wherein mineral oils or hydrocarbon fluids with a selected molecular weight and molecular weight distribution can be obtained thereby enabling high speed printing.

Further, another object of the present invention is to provide liquid developers with mixed isomeric hydrocarbons wherein undesirable high molecular weight components, that can substantially increase the mixture's viscosity, are removed by, for example, distillation.

Another object of the invention is to provide a negatively charged liquid developer wherein there are selected as charge directors certain protonated ammonium salt multiple, especially triblock, copolymers.

It is still a further object of the invention to provide positively charged liquid developer wherein developed image defects, such as smearing, loss of resolution and loss of density, are eliminated, or minimized.

Also, in another object of the present invention there are provided negatively charged liquid developers comprised of branched hydrocarbons with essentially no volatiles and with certain protonated ammonium ABA triblock charge directors, which are superior in embodiments to, for example, AB diblock protonated ammonium block copolymers since, for example, with the ABA there results higher negative toner particle charge. A superior charge observed after two days with, for example, a 1 percent solids magenta developer charged at 7 percent charge director relative to developer solids with the protonated ammonium multiple (ABA) block copolymer charge director, poly[2-ethylhexyl methacrylate (B block)-co-N,N-dimethyl-N-ethyl methacrylate ammonium bromide (A block)], was $2.14\times10^{-10}$ $m^2/Vs$ versus $-1.53\times10^{-10}$ $m^2$ /Vs for the corresponding magenta developer charged at the same level with the corresponding protonated ammonium (AB) diblock copolymer charge director of the same composition except for the absence of multiple A blocks. Similarly, superior charge ($-1.97\times10^{-10}$ $m^2/Vs$) was observed after 2 days for a 1 percent solids cyan (PV FAST BLUE™) developer charged at 5 percent charge director solids relative to developer solids with the above protonated ammonium multiple (ABA) block copolymer charge director versus the corresponding cyan developer ($-1.60\times10^{-10}$ $m^2/Vs$) charged at the same level with the above corresponding protonated ammonium (AB) diblock copolymer charge director. The superior charge can result in improved image development and excellent image transfer.

Also, in another object of the present invention there are provided negatively charged liquid developers with certain zwitterionic quaternary ammonium (ABA) multiple block polymer charge directors, which are superior in embodiments to, for example, zwitterionic quaternary ammonium (AB) diblock copolymers since, for example, with the ABA there results higher negative particle charge. The superior charge observed after only 0.5 hour for a 1 percent solids magenta developer charged at 5 percent charge director solids relative to developer solids with the zwitterionic quaternary ammonium (ABA) multiple block copolymer charge director poly[2-ethylhexyl methacrylate (B block)-co-N,N-dimethyl-N-methylenecarboxylate-N-ammoniumethyl methacrylate (A block)] was $2.88\times10^{-10}$ $m^2/Vs$ versus $-1.87\times10^{-10}$ $m^2/Vs$ for the corresponding magenta developer charged at 7 percent charge director solids relative to developer solids with the corresponding zwitterionic quaternary ammonium (AB) diblock copolymer charge director of the same composition except for the absence of multiple A blocks. Similarly, superior charge ($-2.39\times10^{-10}$ $m^2/Vs$) was observed after 0.5 hour for a 1 percent solids magenta developer charged at 3 percent charge director solids relative to developer solids with the above zwitterionic quaternary ammonium multiple (AB) block copolymer charge director versus the corresponding magenta developer ($-1.84\times10^{-10}$ $m^2/Vs$) charged at 5 percent charge director solids relative to developer solids with the corresponding zwitterionic quaternary ammonium (AB) diblock copolymer charge director of the same composition except for the absence of multiple A blocks. The superior charge can result in improved image development, excellent image transfer, and excellent image resolution.

Another object of the present invention resides in the provision of negatively charged liquid toners comprised of branched hydrocarbon wherein the volatiles have been removed and with ammonium multiple block copolymers, and wherein in embodiments enhancement of the negative charge of NUCREL® based toners, especially cyan and magenta toners, is enhanced; and which multiple block polymers ABA can be derived from alkyl or proton quaternized EHMA-DMAEMA (2-ethylhexylmethylmethacrylate-dimethylaminoethylmethacrylate), and wherein the triblocks can possess highly organized micelles.

These and other objects of the present invention can be accomplished in embodiments by the provision of liquid developers. In embodiments, the present invention is directed to liquid developers comprised of a nonpolar liquid, especially a mixture of saturated hydrocarbons of varying molecular weight and degree of branching and cyclization with essentially no volatiles, toner or thermoplastic resin, pigment, charge additive and a charge director. In embodiments, the aforementioned charge director can be selected from a number of charge directors including those of the copending applications mentioned herein, and more specifically, a charge director containing one or more polar ammonium A blocks and one or more B blocks such that there is a minimum of three blocks and a maximum of ten blocks. The B block constituent or component is nonpolar thereby enabling hydrocarbon solubility. The multiple block copolymers can be obtained from group transfer polymerization, and a subsequent polymer modification reaction of the group transfer prepared multiple block copolymer in which the ammonium site is introduced into the polar A block.

Embodiments of the present invention relate to a liquid electrostatographic developer comprised of (A) a nonpolar liquid with essentially no volatiles, for example less than about 30 ppm volatiles in embodiments, and having a Kauri-butanol value of from about 5 to about 30, and present in a major amount of from about 50 percent to about 95 weight percent; (B) thermoplastic resin particles with, for example, an average volume particle diameter of from about 0.5 to about 30 microns and preferably 1.0 to about 10 microns in average volume diameter, and pigment; (C) a charge director; and (D) optionally a charge adjuvant compound; a liquid electrostatographic developer comprised of (A) a nonpolar branched hydrocarbon liquid having a Kauri-butanol value of from about 5 to about 30 and present in a major amount of from about 50 percent to about 95 weight percent; (B) thermoplastic resin particles and pigment particles; (C) a charge director; and (D) a charge adjuvant, and wherein the volatiles of said nonpolar branched hydrocarbon liquid have been removed from the branched hydrocarbon resulting in a hydrocarbon mixture which is substantially free of components with a retention time of from about zero to about 10 minutes; and a process for reducing the volatiles present in a liquid developer comprised of a nonpolar liquid, thermoplastic resin particles, a charge adjuvant, pigment, and a charge director, which process comprises the heating of said developer at a temperature of from about 25° C. to about 75° C. Moreover, in embodiments, the liquid developer is substantially free of components and with retention times of from about 0 to about 10 minutes, and more specifically, the liquid developer is substantially free of components, that is for example wherein from about 0.01 to about 95 weight percent of nonpolar liquid or hydrocarbon volatiles are removed in embodiments, with retention times of from about 40 to about 1,000 minutes.

Examples of suitable nonpolar liquid soluble charge directors selected for the developers of the present invention in various effective amounts, such as from about 0.1 to about 20 weight percent of developer solids, include ammonium triblock copolymers ABA wherein the A block is the polar block containing positive charge bearing ammonium sites and the B block is the nonpolar block. The polar and nonpolar blocks in the ammonium multiple block copolymers can be comprised of at least two consecutive polar repeat units or nonpolar repeat units, respectively. When trivalent nitrogen in the polar A block is made tetravalent via protonation, a protonated ammonium salt species is formed as the positive charge bearing site. When the trivalent nitrogen in the polar A block is rendered tetravatent via quaternization with an alkylating agent, a quaternary ammonium species is formed as the positive charge bearing site. If in the formation of a quaternary ammonium species in the polar A block a covalently bonded negative charge bearing site is simultaneously formed, the result is a zwitterionic quaternary ammonium site. Polar A blocks containing at least one protonated ammonium salt or at least one zwitterionic positive charge bearing site in the multiple block copolymer charge directors of this invention can provide charging properties superior to the corresponding AB diblock (2 blocks) copolymer charge directors even when the multiple block (at least 3 blocks) copolymer charge directors are present in the liquid developer at lower concentration than the corresponding AB diblock copolymer charge directors.

In embodiments, the ammonium triblock copolymer charge directors are preferably comprised of A and B blocks. Examples of A blocks are Polar A Blocks

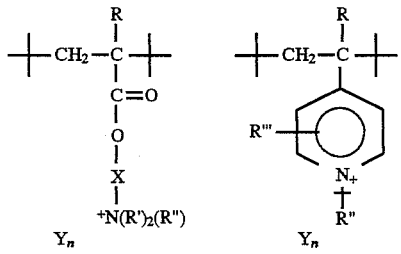

wherein R is hydrogen, alkyl or cycloalkyl of 1 to about 20 carbons, or aryl, alkylaryl, or cycloalkylaryl of 6 to about 24 carbons with or without heteroatoms; X is alkyl or cycloalkyl of 2 to about 20 carbons, aryl, alkylaryl, or cycloalkylaryl of 6 to about 24 carbons with or without heteroatoms; R' is alkyl or cycloalkyl of 1 to about 30 carbons, aryl, alkylaryl or cycloalkylaryl of 6 to about 24 carbons with or without heteroatoms; R" is hydrogen, alkyl or cycloalkyl of 1 to about 20 carbons, aryl, alkylaryl, cycloalkylaryl of 6 to about 24 carbons, alkylene or a cycloalkylene conjugate acid anion of 1 to about 20 carbons, arylene, alkylarylene, arylalkylene, cycloalkylarylene, or an arylcycloalkylene conjugate acid anion of 6 to about 24 carbons with or without heteroatoms; $Y^-$ is a conjugate acid anion of an acid with a pKa less than or equal to about 4.5, preferably less than 3.0 and, for example, from 0.5 to about 3; n is 0 or 1; n is 0 when R" contains a conjugate acid anion; n is 1 when R" does not contain a conjugate acid anion; and R'" is alkyl or cycloalkyl of 1 to about 20 carbons, aryl, alkylaryl, or cycloalkylaryl of 6 to about 24 carbons with or without heteroatoms. Unsubstituted carbons in the pyridine ring are bonded to hydrogen.

Examples of nonpolar B blocks include

Nonpolar B Blocks

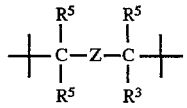

A

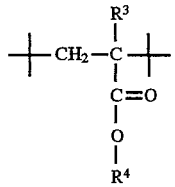

B

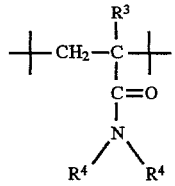

C wherein $R^3$ is hydrogen in B and C, or saturated or unsaturated, linear or branched, alkyl or cycloalkyl of 1 to about 30 carbons in A, B, and C; or saturated or unsaturated, linear or branched, alkylaryl or cycloalkylaryl of about 10 to about 30 carbons in A, B and C with or without known heteroatoms like oxygen, nitrogen, sulfur, and the like; $R^4$ is saturated or unsaturated, linear or branched, alkyl or cycloalkyl of 4 to 30 carbons in A, B, and C; or saturated or unsaturated, linear or branched, alkylaryl or cycloalkylaryl of about 10 to about 30 carbons in A, B, and C with or without heteroatoms; $R^5$ is hydrogen, or saturated or unsaturated, linear or branched, alkyl or cycloalkyl of 1 to 30 carbons in A; or saturated or unsaturated, linear or branched, alkylaryl or cycloalkylaryl of about 10 to about 30 carbons in A with or without heteroatoms; Z is vinylene or arylene or $R^6$ mono or disubstituted vinylene or arylene wherein $R^6$ is hydrogen or saturated or unsaturated, linear or branched, alkyl or cycloalkyl of 1 to 30 carbons; or saturated or unsaturated, linear or branched, aryl, alkylaryl or cycloalkylaryl of about 6 to about 30 carbons in A with or without heteroatoms Z, including a divalent heteroatom such as oxygen or sulfur in embodiments.

Examples of ABA triblock copolymer charge directors include poly[N,N-dimethyl-2-aminoethylmethacrylate hydrogen bromide (A block) co-2-ethylhexyl methacrylate (B block)-co-N,N-dimethyl-2-aminoethylmethacrylate hydrogen bromide (A block)], poly[N,N,N-trimethyl-2-ammoniumethylmethacrylate bromide (A block) co-2-ethylhexyl methacrylate (B block)-co-N,N-trimethyl-2-ammoniumethylmethacrylate bromide (A block)], poly[N,N-dimethyl-N-methylenecarboxylate-N-ammoniumethyl methacrylate (A block)-co-2-ethylhexyl methacrylate (B block)-co-N,N-dimethyl-N-methylenecarboxylate-N-ammoniumethyl methacrylate (A block)], and poly[N,N-dimethyl-N-propylenesulfonate-N-ammoniumethyl methacrylate-co-2-ethylhexyl methacrylate (B block)-co-N,N-dimethyl-N-propylenesulfonate-N-ammoniumethyl methacrylate (A block)].

Examples of nonpolar liquid soluble multiple block quaternary ammonium copolymer charge directors (nonpolar B block named first then polar A block)include poly[2-ethylhexyl methacrylate (B block)-co-N,N,N-trimethyl-N-ethyl methacrylate ammonium bromide (A block)], poly[2-ethylhexyl methacrylate-co-N,N-dimethyl-N-butyl-N-ethyl methacrylate ammonium bromide], poly[2-ethylhexyl methacrylate-co-N,N-dimethyl-N-lauryl-N-ethyl methacrylate ammonium bromide], poly[2-ethylhexyl methacrylate-co-N,N-dimethyl-N-stearyl-N-ethyl methacrylate ammonium bromide], poly[2-ethylhexyl methacrylate-co-N,N-dimethyl-N-methyl-N-ethyl methacrylate ammonium tosylate], poly[2-ethylhexyl methacrylate-co-N,N-dimethyl-N-butyl-N-ethyl methacrylate ammonium tosylate], poly[2-ethylhexyl methacrylate-co-N,N-dimethyl-N-ethyl-N-ethyl methacrylate ammonium tetrafluoroborate], poly[2-ethylhexyl methacrylate-co-N,N,N-trimethyl-N-ethyl methacrylate ammonium phosphate], and poly[2-ethylhexyl methacrylate-co-N,N,N-trimethyl-N-ethyl methacrylate ammonium sulfate].

Examples of useful ABA triblock copolymer charge directors include poly[N,N-dimethyl-2-aminoethylmethacrylate hydrogen bromide (A block) co-2-ethylhexyl methacrylate (B block)-co-N,N-dimethyl-2-aminoethylmethacrylate hydrogen bromide (A block)], poly[N,N,N-trimethyl-2-ammoniumethylmethacrylate bromide (A block) co-2-ethylhexyl methacrylate (B block)-co-N,N-trimethyl-2-ammoniumethylmethacrylate bromide (A block)], poly[N,N-dimethyl-N-methylenecarboxylate-N-ammoniumethyl methacrylate (A block)-co-2-ethylhexyl methacrylate (B block)-co-N,N-dimethyl-N-methylenecarboxylate-N-ammoniumethyl methacrylate (A block)], and poly[N,N-dimethyl-N-propylenesulfonate-N-ammoniumethyl methacrylate-co-2-ethylhexyl methacrylate (B block)-co-N,N-dimethyl-N-propylenesulfonate-N-ammoniumethyl methacrylate (A block)].

The charge director can be selected for the liquid developers in various effective amounts, such as for example from about 0.5 percent to 100 percent by weight relative to developer solids and preferably 2 percent to 20 percent by weight relative to developer solids. Developer solids include toner resin, pigment, and optional charge adjuvant. Without pigment, the developer may be selected for the generation of a resist, or a printing plate, and the like.

Examples of liquid carriers or vehicles selected for the developers of the present invention include a liquid with viscosity of from about 0.5 to about 20 centipoise measured at 20° C., and preferably from about 1.5 to about 15 centipoise, and a resistivity greater than or equal to $5\times10^9$ ohm/centimeters, such as $10^{13}$ ohm/centimeters, or more. Preferably, the liquid selected in embodiments is a mixture of branched chain or branched chain and cyclic, or branched chain and linear and cyclic aliphatic hydrocarbons.

In many liquid copying devices employing liquid toners a nonpolar liquid of the ISOPAR® series available from Exxon Corporation is used. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. Moreover, the vapor pressure at 25° C. should be less than or equal to 10 Torr in embodiments. The liquids selected are known and have an electrical volume resistivity in excess of $10^9$ ohm-centimeters and a dielectric constant below or equal to 3.0. With the present invention, in embodiments the aforementioned liquids contain less than 10 ppm of materials having a retention time less than 10 minutes minimum or no volatiles, which volatiles have been removed by, for example, heating between 25° and 75° C., distillation, and the like thereby providing a mixture of hydrocarbons with optimized vapor concentrations between 0.01 and 30 ppm. More specifically, in embodiments the liquid vapor concentration is reduced by a factor of 3.22 while the viscosity increased by only 14 percent.

The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably 0.5 to 2.0 percent by weight.

Various suitable thermoplastic toner resins can be selected for the liquid developers of the present invention in effective amounts of, for example, in the range of 99 percent to 40 percent of developer solids, and preferably 95 percent to 70 percent of developer solids; developer solids includes the thermoplastic resin, optional pigment and charge control agent and any other component that comprises the particles. Examples of such resins include ethylene vinyl acetate (EVA) copolymers (ELVAX® resins, E.I. DuPont de Nemours and Company, Wilmington, Del.); copolymers of ethylene and an α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series available as BAKELITE®DPD 6169, DPDA 6182 Natural (Union Carbide Corporation); ethylene vinyl acetate resins, for example DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is from 1 to about 20 carbon atoms like methyl methacrylate (50 to 90 percent)/methacrylic acid (0 to 20 percent/ethylhexyl acrylate (10 to 50 percent); and other acrylic resins including ELVACITE® acrylic resins (E.I. DuPont de Nemours and Company); or blends thereof. Preferred copolymers are the copolymer of ethylene and an α-β-ethylenically unsaturated acid of either acrylic acid or methacrylic acid. In a preferred embodiment, NUCREL® like NUCREL® 599, NUCREL® 699, or NUCREL® 960 can be selected as the thermoplastic resin.

The liquid developers of the present invention may optionally contain a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 30 percent by weight based on the total weight of solids contained in the developer. The amount of colorant used may vary depending on the use of the developer. Examples of colorants include pigments like carbon blacks like REGAL 330®, cyan, magenta, yellow, blue, green, brown and mixtures thereof; pigments as illustrated in U.S. Pat. No. 5,223,368, the disclosure of which is totally incorporated herein by reference, and more specifically, the following.

| PIGMENT BRAND NAME | MANUFACTURER | COLOR |
|---|---|---|
| Permanent Yellow | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901F | BASF | Blue 15:2 |
| HELIOGEN ® BLUE TBD 7010 | BASF | Blue:3 |
| HELIOGEN ® BLUE K 7090 | BASF | Blue 15:3 |
| HELIOGEN ® BLUE L 7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, CI 77266 |
| UHLICH ® BK 8200 | Paul Uhlich | Black |

To increase the toner particle charge and, accordingly, increase the mobility and transfer latitude of the toner particles, charge adjuvants can be added to the toner. For example, adjuvants, such as metallic soaps like aluminum or magnesium stearate or octoate, fine particle size oxides, such as oxides of silica, alumina, titania, and the like, paratoluene sulfonic acid, and polyphosphoric acid, may be added. Negative charge adjuvants primarily increase the negative charge or decrease the positive charge of the toner particle, while the positive charge adjuvants increase the positive charge of the toner particles. With the invention of the present application, in embodiments the adjuvants or charge additives can be comprised of the metal catechol and aluminum hydroxy acid complexes illustrated in U.S. Pat. No. 5,306,591 and U.S. Pat. No. 5,308,731, the disclosures of which are totally incorporated herein by reference, and which additives in combination with the charge directors of the present invention have, for example, the following advantages over the aforementioned prior art charge additives: improved toner charging characteristics, namely, an increase in particle charge, as measured by ESA mobility, from −1.4 E-10 $m^2/Vs$ to −2.3 E-10 $m^2/Vs$, that results in improved image development and transfer, from 80 percent to 93 percent, to allow improved solid area coverage, and a transferred image reflectance density of 1.2 to 1.3. The adjuvants can be added to the toner particles in an amount of from about 0.1 percent to about 15 percent of the total developer solids and preferably from about 1 percent to about 5 percent of the total weight of solids contained in the developer.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is required for image development and background cleaning.

Toner particle mobility can be measured using the electroacoustics effect, the application of an electric field, and the measurement of sound, reference U.S. Pat. No. 4,497,208, the disclosure of which is totally incorporated herein by reference. This technique is particularly useful for nonaqueous dispersions because the measurements can be made at high volume loadings, for example greater than or equal to 1.5 to 10 weight percent. Measurements made by this technique have been shown to correlate with image quality, for example high mobilities can lead to improved image density, resolution and improved transfer efficiency. Residual conductivity, that is the conductivity from the charge director, is measured using a low field device as illustrated in the following Examples.

The liquid electrostatic developer of the present invention can be prepared by a variety of known processes such as, for example, mixing in the branched nonpolar liquid, the thermoplastic resin and colorant in a manner that the resulting mixture contains, for example, about 15 to about 30 percent by weight of solids; heating the mixture to a temperature of from about 70° C. to about 130° C. until a uniform dispersion is formed; adding an additional amount of nonpolar liquid sufficient to decrease the total solids concentration of the developer to about 10 to 20 percent by weight; cooling the dispersion to about 10° C. to about 50° C.; adding a charge adjuvant compound to the dispersion; and diluting the dispersion, followed by mixing with the charge director.

In the initial mixture, the resin, colorant and charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer (manufactured by Charles Ross and Son, Hauppauge, N.Y.), or a two roll heated mill, which requires no particulate media. The charge director can be added at any point in the toner preparation, but is preferably added after the particles have been reduced to their desired size. Useful particulate media include particulate materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient, nonpolar liquid is added to provide a dispersion of from about 15 to about 50 percent solids. This mixture is subjected to elevated temperatures during the initial mixing procedure to plasticize and soften the resin. The mixture is sufficiently heated to provide a uniform dispersion of all solid materials, that is colorant, adjuvant and resin. The temperature at which this step is undertaken should not be so high as to degrade the nonpolar liquid or decompose the resin or colorant when present. Accordingly, the mixture is heated to a temperature of from about 70° C. to about 130° C., and preferably to about 75° C. to about 110° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added at this point should be an amount sufficient to decrease the total solids wherein solids include resin, charge adjuvant, and pigment concentration of the dispersion to from about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid, such as water, ethylene glycol, and the like, in a jacket surrounding the mixing vessel. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably 2 to 6 hours. Additional liquid may be added at any step during the preparation of the liquid developer to facilitate grinding or to dilute the developer to the appropriate percent solids needed for developing. Methods for the preparation of developers that can be selected are illustrated in U.S. Pat. Nos. 4,760,009; 5,017,451; 4,923,778 and 4,783,389, the disclosures of which are totally incorporated herein by reference.

Methods of imaging are also encompassed by the present invention wherein after formation of a latent image on a photoconductive imaging member, reference U.S. Pat. No. 5,306,591, the disclosure of which is totally incorporated herein by reference, the image is developed with the liquid toner illustrated herein by, for example, immersion of the photoconductor therein, followed by transfer and fixing of the image, or transfer to an intermediate belt, a second transfer to a substrate like paper, followed by fixing.

The present invention is illustrated in the following nonlimiting Examples, it being understood that these Examples are intended to be illustrative only and that the invention is not intended to be limited to the materials, conditions, process parameters and the like recited herein. All parts and percentages are by weight unless otherwise indicated. Control Examples are also provided. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science, Hopkinton, Mass.). The system was calibrated in the aqueous mode per manufacturer's recommendation to give an ESA signal corresponding to a zeta potential of −26 millivolts for a 10 percent (v/v) suspension of LUDOX™ (DuPont). The system was then set up for nonaqueous measurements. The toner particle mobility is dependent on a number of factors including particle charge and particle size. The ESA system also calculates the zeta potential which is directly proportional to toner charge and is independent of particle size. Particle size was measured by the Horiba CAPA-500 and 700 centrifugal automatic particle analyzer, manufactured by Horiba Instruments, Inc., Irvine, Calif.

EXAMPLE I

Vacuum Devolatilization of Hydrocarbon Carrier Fluids to Remove Volatile Components The five hydrocarbon fluids in Table 1, listed in decreasing order of volatility, were devolatilized by applying a vacuum over the stirred liquid to remove volatile components therein. To a 250 or 500 milliliter single neck round bottom flask were added 125 to 375 milliliters of the hydrocarbon fluid, reference Table 1, selected for devolatilization. A thermometer and vacuum takeoff arm were inserted and a pump vacuum was applied to the contents of the flask. A MacLeod gauge and an air-bleed needle valve were incorporated into the vacuum assembly to measure vacuum (millimeter Hg) and to bleed in air when removing samples (25 to 75 grams) for viscosity and head space vapor pressure measurements. Vacuum was applied initially without heat to degas the hydrocarbon, and for the more volatile hydrocarbons also to remove some of the volatile components. Vacuum was then applied at elevated temperatures to remove less volatile components. Heat was applied by immersing the flask into a temperature controlled silicone oil bath (high temperature silicone oil from Aldrich catalog no. 17,563-3; controlled by a Model 49 proportioning controller from Love Controls) in a temperature range and for a time period sufficient to remove all or most of the lower boiling components. The data in Table 1 provides the vacuum/heating conditions in stages for each hydrocarbon undergoing devolatilization. The weight losses in Table 1 were gravimetrically obtained at ambient temperature by subtracting the weight of the flask assembly and its contents after the indicated devolitalization time period (stage) from the corresponding weight prior to the indicated devolitalization stage.

After completing the stage 1 heating period in the indicated temperature range and for the indicated time for the various hydrocarbons devolatized in Table 1, the remaining hydrocarbon in the flask was cooled under vacuum and was reweighed. The decrease in weight divided by the starting weight of the hydrocarbon times 100 provides the percent weight loss for the stage 1 heating period. The percent weight losses for subsequent heating stages was similarly determined for the Table 1 hydrocarbons. For ISOPAR L™, the most volatile hydrocarbon (Example 1A in Table 1), the ambient temperature loss was over 18 percent for the stage 1 heating period and the total weight loss for both stages was over 45 percent, whereas for the nonvolatile mineral oil fraction (Example 1E in Table 1), a much smaller 4.58 percent weight loss was found even though the latter was devolatilized in a higher temperature range for about the same time as was ISOPAR L™. This 1A to 1E comparison in devolatilization conditions indicates that more energy is required to devolatilize the higher boiling, lower vapor pressure hydrocarbons, such as the mineral oils, versus the lighter hydrocarbon compositions, such as ISOPAR L™.

TABLE 1

Vacuum Devolatilization of Hydrocarbon (HC) Liquids for Viscosity and Vapor Pressure Measurements

| | HC | Vacuum Devolatilization Conditions | | | % | |
|---|---|---|---|---|---|---|
| Ex. No. | Devolatilized | Time | Temp °C. | Pressure mm Hg | Wt. Loss | Comments |
| 1 A | Isopar L | 10 min. | 22.0 | 760 → 0.30 | | Stage 1 |
| | | 2.25 hrs. | 22.0 | 0.30 → 0.10 | | Ambient |
| | | 16.5 hrs. | 22.0 | 0.10 → 0.04 | 18.13 | Temp. |
| | | 40 min. | 22.0 → 45.0 | 760 → 0.15 | | Stage 2 |
| | | 4.0 hrs. | 44.0 → 45.0 | 0.15 → 0.05 | 27.02 | |
| 1 B | Isopar M | 1 hr. | 24.0 | 760 → 0.06 | | Stage 1 |
| | | 22 hrs. | 24.0 | 0.06 → 0.02 | 0.54 | Ambient Temp. |
| | | 1 hr. | 44.5 → 47.0 | 760 → 0.12 | | |
| | | 19.2 hrs. | 43.8 → 46.0 | 0.12 → 0.02 | 3.88 | Stage 2 |
| | | 0.25 hr. | 24.0 → 53.0 | 760 → 0.08 | | |
| | | 44.7 hrs. | 53.0 → 55.5 | 0.08 → 0.06 | 14.38 | Stage 3 |
| 1 C | Isopar V | 23 min. | 23.5 | 760 → 0.01 | No | Stage 1 |
| | | 1.5 hrs. | 23.5 → 62.0 | 0.01 | Wt. | |
| | | 15.5 hrs. | 62.0 → 69.0 | 0.01 | loss found | |
| | | 5 min. | 23.5 | 760 → 0.07 | | Stage 2 |
| | | 2.25 hrs, | 23.5 → 96.0 | 0.07 → 0.18 | | |
| | | 2.0 hrs. | 96.0 → 87.0 | 0.18 → 0.01 | | |
| | | 2.25 hrs. | 87.0 → 125.0 | 0.01 | 6.30 | |
| | | 25 min. | 38.0 → 30.0 | 760 → 0.90 | | Stage 3 |
| | | 15.5 hrs. | 30.0 → 120.0 | 0.90 → 0.70 | 7.99 | |
| 1 D | Superla White MO #5 Special | 13 min. | 23.5 | 760 → 0.15 | | One |
| | | 36 min. | 23.5 → 66.5 | 0.15 | | Heating |
| | | 22 hrs. | 64.5 → 69.0 | 0.06 | 4.14 | Stage Only |

TABLE 1-continued

Vacuum Devolatilization of Hydrocarbon (HC) Liquids for Viscosity and Vapor Pressure Measurements

| Ex. No. | HC Devolatilized | Vacuum Devolatilization Conditions: Time | Temp °C. | Pressure mm Hg | % Wt. Loss | Comments |
|---|---|---|---|---|---|---|
| 1 E | Fractionated Superla White MO #5 | Started with fraction having bp 165° C. at 1.2 mm Hg: | | | | One Heating Stage Only |
| | | 13 min. | 22.0 | 760 → 0.12 | | |
| | | 47 min. | 22.0 → 74.0 | 0.12 → 0.07 | | |
| | | 22 hrs. | 70.0 → 74.0 | 0.07 → 0.03 | 4.58 | |

Table 2 that follows provides data with respect to carrier fluids prior to and subsequent to devolatilization.

TABLE 2

Gas Phase Hydrocarbon Concentration and Absolute Viscosity Data for Hydrocarbon Carrier Fluids Before and After Devolatilization

| Carrier Fluid (Table 1 Entry) | Carrier Fluid Volatility | Temperature (°C.) of HC Gas Phase Measurement | Total HCs in Gas Phase (ppm) | Temperature (°C.) of Absolute Viscosity Measurement | Absolute Viscosity (cp) |
|---|---|---|---|---|---|
| Isopar L (1A) | As Received | 21 | 655 | 20 | 0.55 |
| | | 31 | 827 | 30 | 0.36 |
| | Stage 1 | 21 | 574 | 20 | 0.56 |
| | | 31 | 785 | 30 | 0.37 |
| | Stage 2 | 21 | 591 | 20 | 0.60 |
| | | 31 | 690 | 30 | 0.41 |
| Isopar M (1B) | As Received | 20 | 258 | 20 | 3.61 |
| | | 31 | 363 | 30 | 2.75 |
| | Stage 1 | 20 | 215 | 20 | 3.63 |
| | | 30 | 329 | 30 | 2.75 |
| | Stage 2 | 20 | 216 | 20 | 3.82 |
| | | 30 | 315 | 30 | 2.91 |
| | Stage 3 | 20 | 80 | 20 | 4.11 |
| | | 30 | 94 | 30 | 3.04 |
| Isopar V (1C) | As Received | 20 | 22 | 25 | 2.51 |
| | | 30 | 38 | 35 | 2.11 |
| | Stage 2 | | | 25 | 2.55 |
| | | | | 35 | 2.14 |
| | Stage 3 | | | 25 | 2.81 |
| | | | 35 | 2.36 | |
| Superla White Mineral Oil #5-Special (1D) | As Received | 25 | 50 | | |
| | | 31 | 71 | | |
| | Stage 1 | 20 | <1 | | |
| | | 30 | <1 | | |
| Superla White Mineral Oil #5 | As Received | 25 | 1 | 20 | 14.48 |
| | | | | 25 | 11.90 |
| | | | | 30 | 9.85 |
| | Distilled by Amoco bp 165° C. at 1.2 mm Hg | 20 | 1 | | |
| | | 30 | 1 | | |
| (1E) | Stage 1 | 20 | 1 | | |
| | | 30 | 1 | | |

Other modifications of the present invention may occur to those of ordinary skill in the art based upon a reading of the present disclosure and these modifications are intended to be included within the scope of the present invention.

What is claimed is:

1. A process for reducing the volatiles present in a liquid developer comprised of a nonpolar liquid, thermoplastic resin particles, a charge adjuvant, pigment, and a charge director, which process comprises subjecting said developer to a temperature of 22° C. and to a pressure which is reduced from 760 millimeters of mercury to 0.30 millimeters of mercury during a period of 10 minutes, followed by subjecting said developer to a temperature of 22° C. and to a pressure which is reduced from 0.30 millimeters of mercury to 0.10 millimeters of mercury during a period of 2.25 hours, followed by subjecting said developer to a temperature of 22° C. and to a pressure which is reduced from 0.10 millimeters of mercury to 0.04 millimeters of mercury during a period of 16.5 hours, thereafter heating said developer at a temperature of from 22° C. to 45° C. for 40 minutes, and wherein the pressure is 0.015 millimeters of mercury, and thereafter heating said developer at a temperature of 44° C. to 45° C. for 4 hours at a pressure of 0.05 millimeters of mercury.

2. A process in accordance with claim 1 wherein from about 0.01 to about 50 weight percent of said nonpolar liquid is removed as volatiles.

3. A process in accordance with claim 1 wherein said liquid is a perfluorinated hydrocarbon, a partially fluorinated hydrocarbon, mixtures thereof, a polydialkyl siloxane or a mixture of polydialkyl siloxanes.

4. A process in accordance with claim 1 wherein the nonpolar liquid is a mixture of hydrocarbons, and which mixture is substantially free of components with retention times of from between about 0 to about 10 minutes, and wherein said hydrocarbon mixture is substantially free of components with retention times of from about 40 to about 1,000 minutes.

5. A process for reducing the volatiles present in a liquid developer consisting essentially of a nonpolar liquid, thermoplastic resin particles, a charge adjuvant, pigment, and a charge director, which process consists essentially of subjecting said developer to a temperature of 22° C. and to a pressure which is reduced from 760 millimeters of mercury to 0.30 millimeters of mercury during a period of 10 minutes, followed by subjecting said developer to a temperature of 22° C. and to a pressure which is reduced from 0.30 millimeters of mercury to 0.10 millimeters of mercury during a period of 2.25 hours, followed by subjecting said developer to a temperature of 22° C. and to a pressure which is reduced from 0.10 millimeters of mercury to 0.04 millimeters of mercury during a period of 16.5 hours, thereafter heating said developer at a temperature of from 22° C. to 45° C. for 40 minutes, and wherein the pressure is 0.015 millimeters of mercury, and thereafter heating said developer at a temperature of 44° C. to 45° C. for 4 hours at a pressure of 0.05 millimeters of mercury.

6. A process for reducing the volatiles present in a liquid developer consisting of a nonpolar liquid, thermoplastic resin particles, a charge adjuvant, pigment, and a charge director, which process consists essentially of subjecting said developer to a temperature of 22° C. and to a pressure which is reduced from 760 millimeters of mercury to 0.30 millimeters of mercury during a period of 10 minutes, followed by subjecting said developer to a temperature of 22° C. and to a pressure which is reduced from 0.30 millimeters of mercury to 0.10 millimeters of mercury during a period of 2.25 hours, followed by subjecting said developer to a temperature of 22° C. and to a pressure which is reduced from 0.10 millimeters of mercury to 0.04 millimeters of mercury during a period of 16.5 hours, thereafter heating said developer at a temperature of from 22° C. to 45° C. for 40 minutes, and wherein the pressure is 0.015 millimeters of mercury, and thereafter heating said developer at a temperature of 44° C. to 45° C. for 4 hours at a pressure of 0.05 millimeters of mercury.

* * * * *